US009437354B2

(12) United States Patent
Ponce Vélez et al.

(10) Patent No.: US 9,437,354 B2
(45) Date of Patent: Sep. 6, 2016

(54) VOLTAGE SURGE PROTECTOR HAVING A PRESSURE RELEASE MECHANISM

(76) Inventors: Marco Antonio Ponce Vélez, Jiutepec (MX); Claudio Torres Nava, Cuernavaca (MX)

( * ) Notice: Subject to any disclaimer, the term of this patent is extended or adjusted under 35 U.S.C. 154(b) by 326 days.

(21) Appl. No.: 14/392,023

(22) PCT Filed: Aug. 1, 2012

(86) PCT No.: PCT/MX2012/000075

§ 371 (c)(1),
(2), (4) Date: Feb. 19, 2015

(87) PCT Pub. No.: WO2013/019097

PCT Pub. Date: Feb. 7, 2013

(65) Prior Publication Data

US 2015/0340134 A1 Nov. 26, 2015

(30) Foreign Application Priority Data

Aug. 1, 2011 (MX) ..... MX/a/2011/008109

(51) Int. Cl.
*H01C 7/10* (2006.01)
*H01C 7/12* (2006.01)
*H01C 1/02* (2006.01)

(52) U.S. Cl.
CPC ..... *H01C 7/126* (2013.01); *H01C 1/02* (2013.01)

(58) Field of Classification Search
CPC ..... H01C 7/126; H01C 1/02
USPC ..... 338/21, 10; 361/124
See application file for complete search history.

(56) References Cited

U.S. PATENT DOCUMENTS

| | | | | |
|---|---|---|---|---|
| 5,602,710 | A * | 2/1997 | Schmidt | H01C 7/12 361/117 |
| 5,652,690 | A * | 7/1997 | Mansfield | H01C 7/12 361/117 |
| 5,818,677 | A * | 10/1998 | Bennett | H01C 8/04 361/118 |
| 6,344,789 | B1 * | 2/2002 | Udagawa | H01C 7/12 338/20 |
| 6,847,514 | B2 * | 1/2005 | Ramarge | H01C 7/12 361/111 |
| 8,629,751 | B2 * | 1/2014 | Maher | H01C 7/102 338/20 |
| 2015/0340134 | A1 * | 11/2015 | Ponce Velez | H01C 7/126 338/21 |

* cited by examiner

*Primary Examiner* — Kyung Lee
(74) *Attorney, Agent, or Firm* — Michael W. Goltry; Robert A. Parsons; Parsons & Goltry

(57) ABSTRACT

A voltage surge protector consisting of a plurality of varistors connected in a column, an upper electrode connected to the upper edge of the column of varistors, a lower electrode connected to the lower edge of the column of varistors, an insulating housing that surrounds the column of varistors, a fiberglass cover that surrounds the insulating housing and a weatherproof protective cover provided with barriers mounted on the fiberglass cover. The protector has a mechanism to release pressure during a voltage surge, which consists of a hole in a transversal direction for each varistor of the column of varistors inside the insulating housing, the holes being helicoidally distributed along the length of the housing of insulating material and of a depth less than the thickness of the insulating housing.

7 Claims, 4 Drawing Sheets

VOLTAGE SURGE PROTECTOR HAVING A PRESSURE RELEASE MECHANISM

TECHNICAL FIELD OF THE INVENTION

This invention relates to the field of voltage surge protector that drain to ground surges due to lightning strokes and that are installed on transmission lines of medium and high voltage, and more precisely, relates to a voltage surge protector having a mechanism consisting of a plurality of holes being helicoidally distributed to release pressure during a voltage surge in the event of a lightning surge and prevent the release of fragments out of said voltage surge protector.

BACKGROUND OF THE INVENTION

Voltage surge protectors currently draining to ground lightning surges and that are installed in transmission lines of medium and high voltage are generally formed by a plurality of varistors connected by way of a column, an upper electrode connected to the upper edge of the column of varistors, a lower electrode connected to the lower edge of the column of varistors, an insulating housing surrounding the column of varistors, a fiberglass cover surrounding the insulating housing and a weatherproof protective cover provided with barriers mounted on the fiberglass cover. Some examples of patent documents that describe the configuration of this type of devices are Japanese Patent Publication JP-61151913 and the publication of Japanese Utility Model JP-196739.

Under this basic structure of this type of voltage surge protector, upon receiving a lightning surge, high pressure is generated inside the device which causes the explosion of the same, and therefore its fragmentation and dangerous launching of the fragments out of the device.

According the test standard IEC 60099-4 (short circuit test), these devices may fail imminently upon receiving a lightning stroke but its structure must avoid a dangerous explosion and release of fragments in the form of projectiles. Therefore, mechanisms are implemented to release the pressure generated by a surge in the protective devices consisting of the placement of grooves or holes in the wall of the insulating housing, as described in Japanese patent application publication JP61151913, in U.S. Pat. No. 5,113,306, and in published European patent application EP-0493134. However, these grooves or holes do not fully prevent this problem, as they are axially arranged along the wall of the insulating housing in a straight line setting, that, although decreasing the outward launching of fragments during the explosion, cause the protective device to split in half or more fragments that can still be launched outward as projectiles.

Therefore, the prior art continues to present the problems as described above, so there is still a need to provide a voltage surge protector that during a lightning stroke explodes without throwing fragments outward and therefore fully complies with testing standard IEC-60099-4.

SUMMARY OF THE INVENTION

In view of the aforementioned and with the aim of solving the constraint found, it is the object of this invention to provide a voltage surge protector formed by a plurality of varistors connected in a column, an upper electrode connected to the upper edge of the column of varistors, a lower electrode connected to the lower edge of the column of varistors, an insulating housing that surrounds the column of varistors, and a weatherproof protective cover provided with barriers mounted on the insulating housing; the insulating housing has a hole in a transversal direction for each varistor of the column of varistors inside the insulating housing, the holes being helicoidally distributed along the length of the insulating housing and each hole has a depth less than the thickness of the wall of the insulating housing.

Another object of the invention is to provide a voltage surge protector whose insulating housing prevents penetration of moisture into the column of varistors being composed of 40% to 52% by weight of silica sand with a particle size of not less than 70% by weight of particles which are retained on a mesh sieve number 60 and not more than 30% by weight of particles which are retained on a mesh sieve number 40; from 23% to 36% by weight of silica sand with a size particle of not less than 80% by weight of particles which are retained on a mesh sieve number 325 and not greater than 11% by weight of particles which are retained on a mesh sieve number 200; and from 3% to 8% by weight of alumina particles; from 4% to 24% by weight of polyester precursor of ortho or isophthalic unsaturated whose viscosity is from 50 to 8.000 cps at room temperature; from 0.1% to 0.7% by weight of a curing agent based benzoyl peroxide; from 0.05% to 0.5% by weight of a cross-linking agent of organosilane, from 0.001% to 0.2% by weight of a silicone oil lubricant; from 0.5% to 1.5% by weight of a plasticizer stearate, and 0.01% to 0.1% by weight of a phenolic antioxidant.

BRIEF DESCRIPTION OF THE FIGURES

The characteristic details of the invention are described in the following paragraphs in conjunction with the accompanying figures, which are for the purpose of defining the invention but without limiting the scope thereof.

DETAILED DESCRIPTION OF THE INVENTION

The characteristic details of the invention are described in the following paragraphs, which are for the purpose of defining it without limiting the scope thereof.

Unless otherwise specified, all figures that include amounts, percentages, portions and ratios are modified by the word "about" and not intended to indicate significant digits.

Except as otherwise indicated, the articles "a," "the," "an" and "the" mean "one or more".

In the context of the present description, the term "about" means a standard deviation of +−3% of the indicated value.

The voltage surge protector of the present invention drains surges caused by a lightning stroke or by the system itself, while the testing mechanism to show the reason for the holes in the housing (which are described hereunder) is a short circuit test that simulates the current flow through the equipment for a certain time and this current can be the lightning or the system itself because it is considered that when the equipment operates it receives the short circuit current of the system itself.

Figure 1:
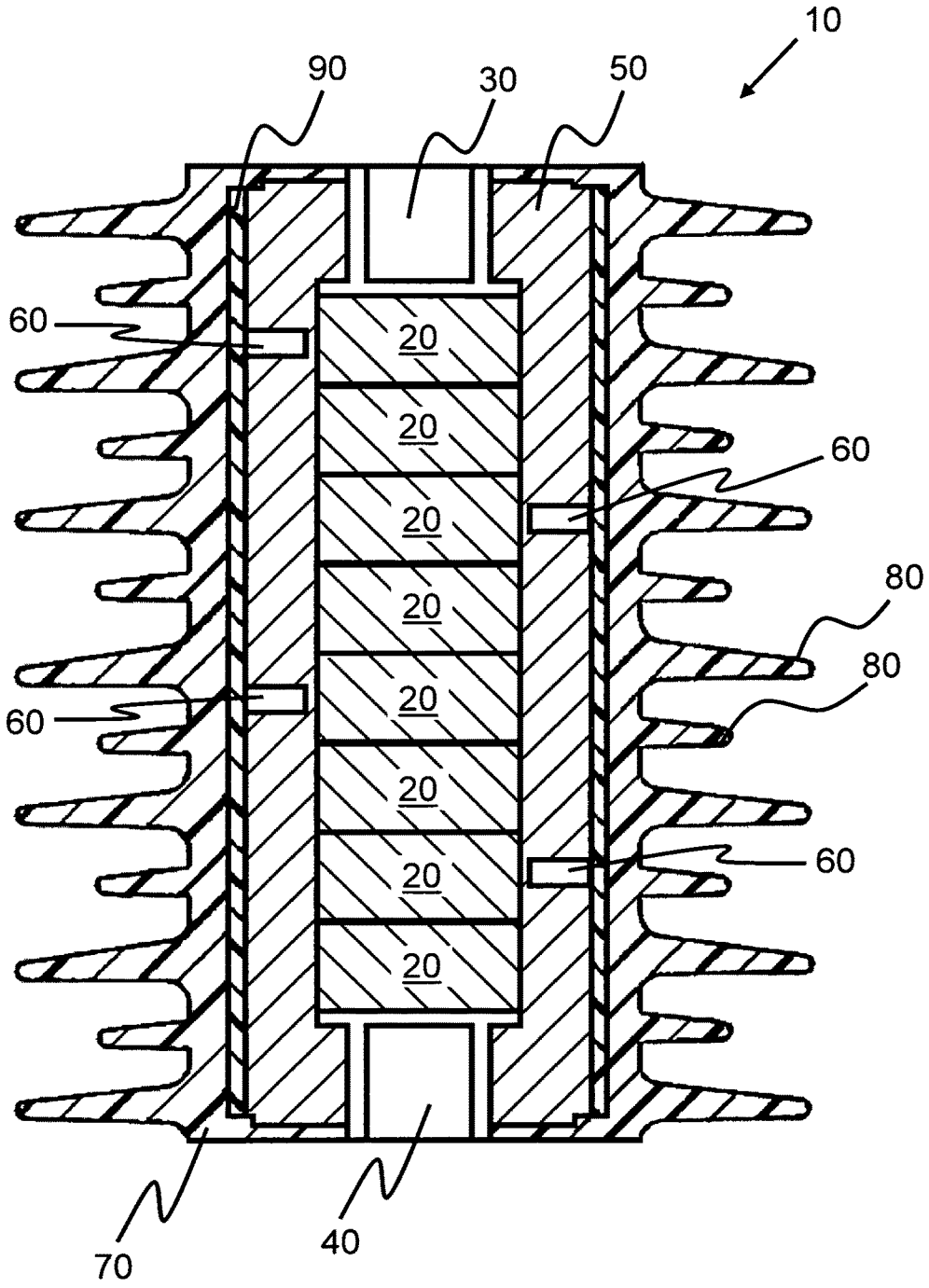
FIG. 1 illustrates a side sectional view of a voltage surge protector according to the invention.

FIG. 1 illustrates a voltage surge protector 10 comprising a plurality of varistors 20 connected in a column, an upper electrode 30 connected to the upper edge of the column of varistors 20, a lower electrode 40 connected to the lower edge of the column of varistors 20, an insulating housing 50 surrounding the column of varistors 20, and a weatherproof protective cover 70 provided with barriers 80 mounted on the insulating housing 50. FIG. 1 shows only one of many possible embodiment of a voltage surge protector according to the present invention. It is evident that suitable modifications can be made known in the art to this embodiment without deviating from the scope of the present invention.

Each varistor 20 is made of one or various metal oxides with non-linear characteristics of voltage-current, for example, zinc oxide and bismuth oxide as an additive plus zinc oxide, and are interconnected in a column configuration (stacked) by means of an adhesive of silica sand mesh sieve 200, titanium dioxide, alumina, resin, silane, and methyl ethyl ketone peroxide. Other useful elements to maintain the column configuration of the varistors 20 are, for example, glass fiber cloth with resin and fiber glass tubes to form a cage.

The upper electrode 30 is fixedly secured and connected to the upper edge of the column of varistors 20; whereas the lower electrode 40 is fixedly secured and connected to the lower edge of the column of varistors 20. The upper and lower electrodes 30 and 40 are metal, preferably brass or stainless steel and are fixed to the column of varistors 20 by means of an adhesive. In this embodiment of the invention, upper and lower electrodes 30 and 40 are cylindrically shaped with a threaded hole (not shown) which allows them to be mechanically coupled to other connection devices.

The insulating housing 50 surrounding the column of varistors 20 also surrounds the major part of the upper and lower electrodes 30 and 40. The insulating housing 50 consists mainly of a thermoplastic polymer, in particular it is made of a polymerizable composition resistant to carbonization and useful for the manufacture of electrical insulations whose polymerizable composition consists of about 40% to about 52% by weight of silica sand with a particle size not smaller than about 70% by weight of particles which are retained on a mesh sieve number 60 and not bigger than about 30% by weight of particles which are retained on a mesh sieve number 40, of about 23% to about 36% by weight of silica sand with a particle size not smaller than about 80% by weight of particles which are retained on a mesh sieve number 325 and not bigger than about 11% by weight of particles which are retained on a mesh sieve number 200, of about 3% to about 8% by weight of alumina particles, of about 4% to about 24% by weight of polyester precursor of ortho or isophthalic unsaturated type whose viscosity is about 50 to about 8,000 cps at room temperature, of about 0.1% to about 0.7% by weight of a curing agent based on benzoyl peroxide, of about 0.05% to about 0.5% by weight of an cross-linking agent based on organosilane, of about 0.001° A) to about 0.2% by weight of a silicone oil lubricant, of about 0.5% to about 1.5% by weight of a plasticizer stearate, and of about 0.01% to about 0.1% by weight of a phenolic antioxidant. Examples of the polymerizable composition for the insulating housing 50 are described in detail in U.S. Pat. No. 5,426,145.

The polymerizable composition of the insulating has 50 prevents the penetration of humidity into the column of varistors 20, as the column of varistors 20 is encapsulated by the composition through a molding process (by pressure and temperature) that removes the air content, and because the composition has the property of contracting when it cures, thus eliminating gaps in the structure.

The insulating housing 50 is equipped on its outer surface with a pressure relief mechanism for when a surge occurs, this mechanism has a hole 60 in transverse direction by each of the varistors 20 forming the varistor column, so that a plurality of holes is formed 60 distributed along the outer surface of the insulating housing 50 in a helical configuration. This helical distribution of the holes 60 on the insulating housing 50 has the advantage over the prior art, to cause a controlled failure which prevents explosion or a fragmentation by parts of the protective device 10 at the moment of a surge.

Alternatively, on the insulating housing 50 a fiberglass cover can be placed 60 that provides the largest single structure to the arrangement and reinforces at the same time the containment of the insulating housing 50.

The weatherproof protective cover 70 covers the insulating housing 50 or the cover structure of fiberglass 60 and the insulating housing 50 to protect the protective device 10 against harmful environmental influences. The weatherproof protective cover 70 is formed by an elastomeric polymer, preferably based on an ethylene rubber, of propylene, silicone, fluorinated silicone or a fluorocarbon rubber, and is advantageously produced by compression molding. The weatherproof protective cover 70 having a plurality of barriers 80 constructed radially as a lean-to roof and inserted, one of a smaller diameter than the other to avoid the continuous draining of water.

Figure 2:
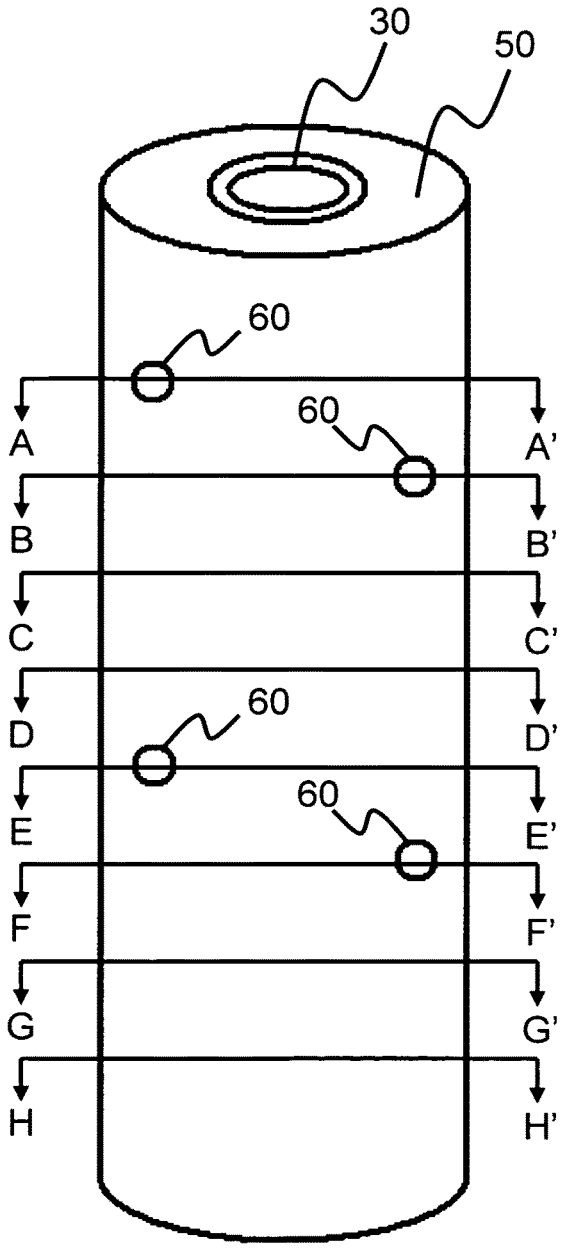
FIG. 2 illustrates a perspective view of an insulating housing according to the invention.

Now FIGS. 2 and 3A to 3H show the embodiment of the insulating housing 50 with the pressure relief mechanism that would act during a surge. The insulating housing 50 has a plurality of holes distributed in a helical configuration. Each hole 60 has a depth less than the wall thickness of the insulating housing 50, that is, does not penetrate the entire wall of the insulating housing 50. In the axial direction of the insulating housing 50, each hole 60 is separated from another adjacent hole 60 at a distance about equal to the thickness of a varistor 20; whereas in the direction from top to bottom of the insulating housing 50, each hole 60 is radially spaced from the adjacent superior hole 60 at an angle of about 45° to about 90°, so that the holes 60 are helically distributed along the insulating housing 50. For this embodiment, inside the insulating housing 50 there is a column formed by eight varistors 20 and on the surface of the insulating housing 50 there is a hole 60 for each varistor, therefore it has eight holes 60 on the surface of the insulating housing 50 distributed in a helical configuration, as illustrated in FIG. 2.

Figure 3A:
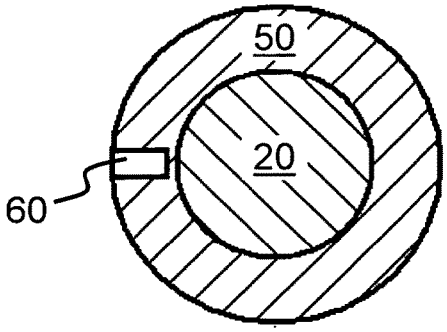
FIGS. 3A-3H illustrate cross-sectional views along the FIG. 2, FIG. 3A being a cross section along the line A-A', FIG. 3B a cross sectional view along cutting line B-B', FIG. 3C a cross-section along cutting line C-C', FIG. 3D a cross section along cutting line D-D', FIG. 3E a cross section along cutting line E-E', FIG. 3F a cross section along cutting line F-F', FIG. 3G a cross section along cutting line G-G' and FIG. 3H a cross sectional view along cutting line H-H'.
Figure 3B:
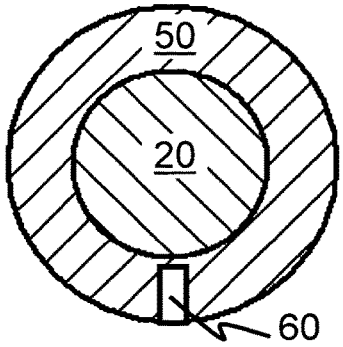
Figure 3C:
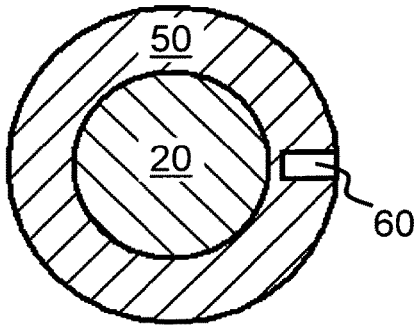
Figure 3D:
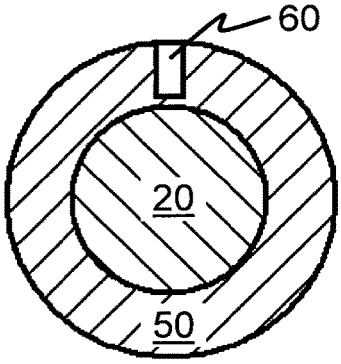
Figure 3E:
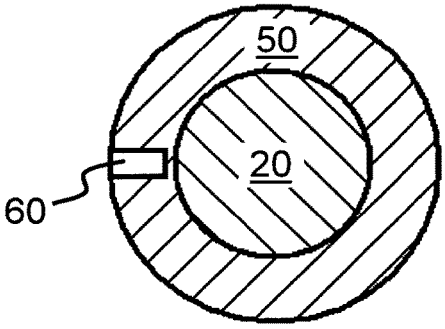
Figure 3F:
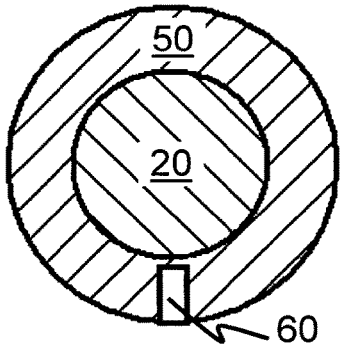
Figure 3G:
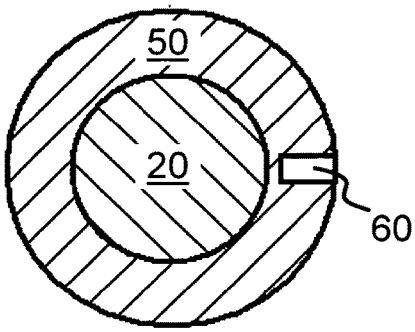
Figure 3H:
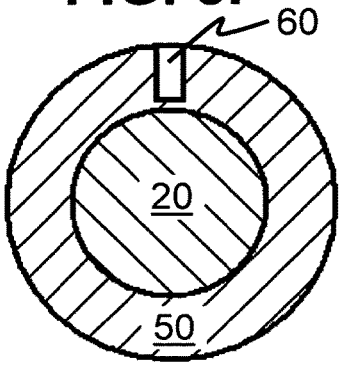

FIGS. 3A to 3H illustrate the helical distribution of the plurality of holes 60 by transverse cuts along the insulation housing 50 in FIG. 2, each hole 60 is radially spaced respect the superior adjacent hole 60 at an angle of about 90°, so that FIG. 3A is a cross sectional view along cutting line AA' of FIG. 2 and showing hole 60 which is located at an angle of 180°; FIG. 3B is a cross sectional view along cutting line BB' of FIG. 2 and showing hole 60 located at an angle of 270°; FIG. 3C is a cross sectional view along cutting line CC' of FIG. 2 and showing hole 60 located at an angle of 0°; FIG. 3D is a cross sectional view along the cutting line DD' of FIG. 2 and showing hole 60 located at an angle of 90°; FIG. 3E is a cross sectional view along cutting line EE' of FIG. 2 showing hole 60 located at an angle of 180°; FIG. 3F is a cross sectional view along cutting line FF' of FIG. 2 showing hole 60 located at an angle of 270°, FIG. 3G is a cross sectional view along cutting line GG' in FIG. 2 and showing hole 60 located at an angle of 0°, and FIG. 3H is a cross sectional view along cutting line HH' of FIG. 2 and showing hole 60 located at an angle of 90°.

The holes 60 may have a form of a rectangular parallelepiped, prism, rectangular pyramid, truncated rectangular pyramid, right cylinder, right cone, truncated right cone, spherical segment of a base or combinations thereof. Preferably the holes 60 have a shape of a right cylinder with a diameter of about 6 mm to about 18 mm and a depth of about 6 mm to about 18 mm.

With the holes 60 distributed helically over the insulating housing 50 a spiral failure is caused at the moment of a surge with multiple fractures in the insulating housing 50, forming a "network of fractures" releasing pressure sideways rather than exploding and throwing fragments, while an axial stress is generated that forces the varistors 20 to rise and fall as an energy absorbing spring, so that the insulating housing tends to break, but maintaining the structure and in the best case is self-supporting, i.e. destroyed in pieces, but not shattered or exploded.

During a surge due to a lightning stroke the failure is random in the varistor column 20, that is, it cannot be claimed that a particular varistor 20 or a group of varistors 20 fail or explode; therefore it is advisable to have at least one hole 60 in the insulating housing 50 for each varistor 20 in order to release the pressure caused by the possible failure or possible explosion of this varistor 20.

In order to compare a protective device D1 with a mechanism to release pressure produced according to the state of the art with a protective device D2 with a mechanism to release pressure prepared in accordance with the present invention, both devices were produced with the following characteristics in common: an insulating housing having a height of 193 mm, a wall thickness of 19.2 mm and 92.4 mm diameter, and a column of varistors with a height of 146 mm and a diameter of 54 mm.

Holes were produced in the wall of the insulation housing of protective device D1 distributed as a straight line according to prior art, while the holes in the wall of the protective device D2 were helically distributed according to the present invention.

Figure 4:
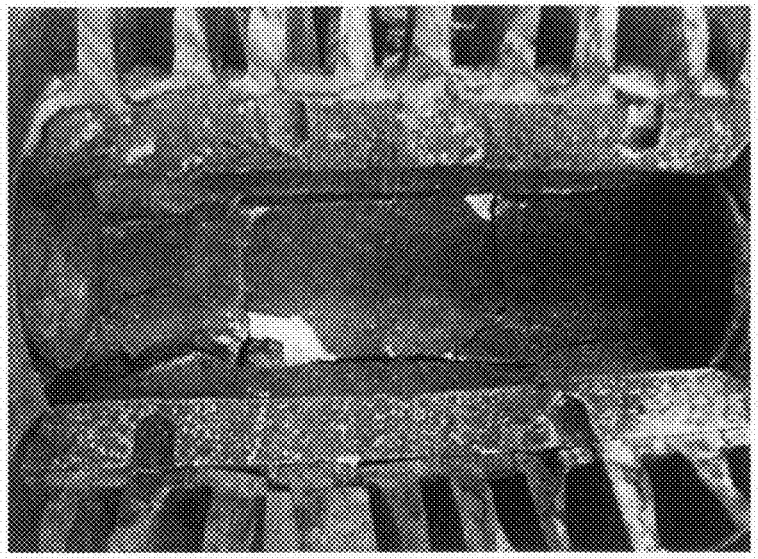
FIG. 4 illustrates a photograph of a voltage surge protector with a pressure relief mechanism according to the prior art and which has been subjected to a surge.

FIG. 4 illustrates a photograph of a protective device D1 with a pressure relief mechanism according to the prior art and which has been subjected to a surge. It can be observed that two fractures were generated (one at an angle of 45° to the other) all along the insulating housing, continuing along the holes and breaking in half with throwing out fragments.

Figure 5:
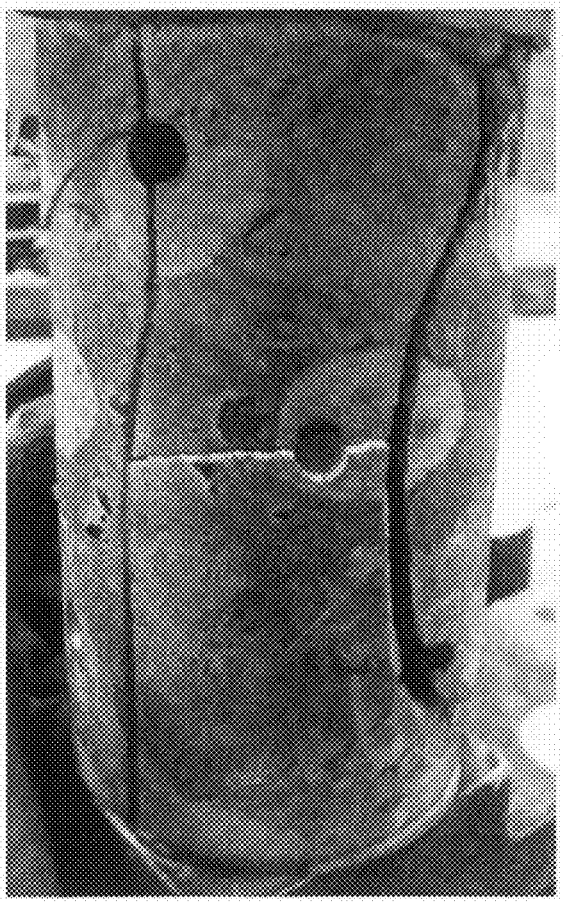
FIG. 5 illustrates a photograph of a voltage surge protector with a pressure relief mechanism according to the invention and which has been subjected to a surge.

Furthermore, FIG. 5 illustrates a photograph of a protective device D2 with the pressure relief mechanism according to the invention and which has been subjected to a surge, wherein the formation of a "network of fractures" is observed along the entire length of the insulating housing while maintaining the structure in a self-supporting way, i.e. broken into pieces but not shattered or exploded.

By taking into account the phenomenon of rotation of the short circuit arc, as indicated by Joseph Spencer in his thesis "SOME INVESTIGATIONS OF THE BEHAVIOUR OF A ROTATING ARC DISCHARGE" UNIVERSITY OF LIVERPOOL (UNITED KINGDOM) 1987, together with the complex interaction of the magnetic field and arc current as main factors causing the rotation, it is imperative when designing the protective device of the present invention to take into account the following technical basics:

1) The parameters considered during the period of peak current and zero current are: Arc current, magnetic flux density, phase difference between the excitation current and the resulting magnetic flux, rotation speed, arc length and the critical voltage range recovery (RRRV) after the zero current.
2) Lorentz forces resulting from the tri-dimensional orientation of both (the magnetic coating and arc current are the primary and dominant force to cause rotation of the arc).

In view of this it is claimed that the complex interaction of several primary parameters during conduction of the arc and its aerodynamics and electrical behavior cause the rotation of the arc together with the holes 60 helically distributed along the insulating housing 50 will allow a controlled mechanical failure of the protective device.

Based on the above described embodiments, it is contemplated that modifications to these embodiments described and the alternative embodiments will be considered obvious to a person skilled in the art under the present description. It is therefore considered that the claims cover such alternative embodiments that are within the scope of the present invention or its equivalents.

The invention claimed is:

1. A voltage surge protector comprising a plurality of varistors connected in a column, an upper electrode connected to the upper edge of the column of varistors, a lower electrode connected to the lower edge of the column of varistors, an insulating housing that surrounds the column of varistors, and a weatherproof protective cover provided with barriers mounted on the insulating housing; characterized in that the insulating housing has a hole in a transversal direction for each varistor of the column of varistors inside the insulating housing, the holes being helicoidally distributed along the length of the insulating housing and each hole has a depth less than the thickness of the wall of the insulating housing.

2. The voltage surge protector according to claim 1, characterized in that in the axial direction of the insulating housing, each hole is separated from other adjacent hole at a distance about equal to the thickness of a varistor.

3. The voltage surge protector according to claim 1, characterized in that in the direction from top to bottom of the insulating housing, each hole is separated radially from the other adjacent superior hole to an angle of 45° to 90°.

4. The voltage surge protector according to claim 1, characterized in that each hole has a form selected from a group that consists of a rectangular parallelepiped, right prism, rectangular pyramid, truncated rectangular pyramid, right cylinder, right cone, truncated right cone, spherical segment of a base, and combinations thereof.

5. The voltage surge protector according to claim 4, characterized in that each hole has a shape of a right cylinder having a diameter of 6 mm to 18 mm.

6. The voltage surge protector according to claim 4, characterized in that each hole has a depth of 6 mm to 18 mm.

7. The voltage surge protector according to claim 1, characterized in that said insulating housing prevents penetration of moisture into said column of varistors and consists of a polymerizable composition comprising:

from 40% to 52% by weight of silica sand with a particle size of not less than 70% by weight of particles which are retained on a mesh sieve number 60 and not more than 30% by weight of particles which are retained on mesh sieve number 40;

from 23% to 36% by weight of silica sand with a particle size of not less than 80% by weight of particles which are retained on a mesh sieve number 325 and not more than 11% by weight of particles which are retained on mesh sieve number 200;

from 3% to 8% by weight of alumina particles;

from 4% to 24% by weight of the polyester precursor of ortho or isophthalic unsaturated type whose viscosity is from 50 to 8,000 cps at room temperature;

from 0.1% to 0.7% by weight of a curing agent based on benzoyl peroxide;

from 0.05% to 0.5% by weight of an cross-linking agent based on organosilane;

from 0.001% to 0.2% by weight of a silicone oil lubricant;

from 0.5% to 1.5% by weight of a plasticizer stearate, and from 0.01% to 0.1% by weight of a phenolic antioxidant.

* * * * *